US010555853B2

(12) United States Patent
Hung

(10) Patent No.: US 10,555,853 B2
(45) Date of Patent: Feb. 11, 2020

(54) HEALTH CARE AIR-FLOW HEATING/COOLING MATTRESS

(71) Applicant: Chi Keung Hung, Fujian (CN)

(72) Inventor: Chi Keung Hung, Fujian (CN)

( * ) Notice: Subject to any disclaimer, the term of this patent is extended or adjusted under 35 U.S.C. 154(b) by 351 days.

(21) Appl. No.: 15/513,158

(22) PCT Filed: Sep. 25, 2015

(86) PCT No.: PCT/CN2015/090688
§ 371 (c)(1),
(2) Date: Mar. 22, 2017

(87) PCT Pub. No.: WO2016/045610
PCT Pub. Date: Mar. 31, 2016

(65) Prior Publication Data

US 2017/0296412 A1 Oct. 19, 2017

(30) Foreign Application Priority Data

Sep. 26, 2014 (CN) ..... 2014 2 0558674 U

(51) Int. Cl.
*A61G 7/057* (2006.01)
*A47C 21/04* (2006.01)

(52) U.S. Cl.
CPC ..... *A61G 7/05784* (2016.11); *A47C 21/044* (2013.01); *A47C 21/048* (2013.01); *A61G 7/05776* (2013.01); *A61G 2210/70* (2013.01); *A61G 2210/90* (2013.01)

(58) Field of Classification Search
CPC ..... A61G 7/05784; A61G 7/05776; A61G 7/05769; A61G 2210/70; A61G 2210/90; A47C 21/04; A47C 21/042; A47C 21/046; A47C 21/044; A47C 21/048; A47C 23/047; A47C 27/081; A47C 27/0882; A47C 27/084; A47C 27/10
See application file for complete search history.

(56) References Cited

U.S. PATENT DOCUMENTS 3,148,391 A * 9/1964 Whitney ..... A61G 7/05776 297/DIG. 3
3,486,177 A * 12/1969 Marshack ..... A61G 7/057 219/212
4,860,397 A * 8/1989 Gusakov ..... A47C 27/081 5/707

(Continued)

*Primary Examiner* — Nicholas F Polito
*Assistant Examiner* — Rahib T Zaman

(57) ABSTRACT

A multifunctional mattress having a mattress body and a heating/cooling pressurization apparatus connected to the mattress body; the mattress body comprises independent pressurized circular balloons, alternatingly pressurized square balloons, heating/cooling air supply tubes, and pressurized tubing; the two sides of said heating/cooling air supply tubes are provided with small blow holes; the independent pressurized circular balloons (3) has a surface layer and a bottom layer; the surface layer and bottom layer are joined to form a plurality of independent closed balloons (33); at a position corresponding to the head are independent pressurized circular balloons; the alternatingly pressurized square balloon areas can be inflated or deflated by means of balloons causing the upper layer of sealed balloons to rise or fall.

4 Claims, 5 Drawing Sheets

(56) References Cited

U.S. PATENT DOCUMENTS

| | | | | |
|---|---|---|---|---|
| 5,109,560 | A * | 5/1992 | Uetake | A61G 7/05784 5/713 |
| 6,216,299 | B1 * | 4/2001 | Kohlman | A61G 5/1043 5/654 |
| 6,668,405 | B1 * | 12/2003 | Kohlman | A61G 5/1043 5/653 |
| 7,945,979 | B1 * | 5/2011 | Lin | A47C 21/044 5/423 |
| 8,353,069 | B1 * | 1/2013 | Miller | A47C 21/048 5/421 |
| 8,789,224 | B2 * | 7/2014 | Wyatt | A61G 7/0525 5/710 |
| 9,566,202 | B2 * | 2/2017 | Chiang | A61G 7/00 |
| 10,130,538 | B2 * | 11/2018 | Toms | A61G 7/05769 |
| 2005/0045623 | A1 * | 3/2005 | Schenck | A47C 7/021 219/528 |
| 2006/0117488 | A1 * | 6/2006 | Hung | A47C 27/082 5/713 |
| 2014/0082840 | A1 * | 3/2014 | Khowaylo | A47G 9/0246 5/499 |

* cited by examiner

HEALTH CARE AIR-FLOW HEATING/COOLING MATTRESS

BACKGROUND OF THE INVENTION

The present invention relates to a kind of mattress, and more specifically relates to a kind of health care air-flow heating/cooling mattress.

A mattress available nowadays is usually a foam mattress or a spring coil mattress. Another kind of mattress called an air bed which is formed by an air bag is also available in the market. An air bed is much more desired by a person or a patient who needs to stay on the bed for most of the time. It is because an air bed is usually softer. However, since an air bed is poorly ventilated and contacts a large surface area of the body, users may easily develop sores and feel hot and stuffy, and may even suffer from rashes and acnes. Moreover, it is also not easy to turn the body on the air bed. Therefore, an air bed has poor applicability. Furthermore, due to the specialty of human body which has skin cells that can breathe and which has capillary vessels of the skin stretching like a net, a large area of skin cells on the back of the body are pressurized for a long period of time during sleep due to large surface contact between the mattress and the back of the body that lies on the mattress. As a result, the capillary vessels are pressurized and the blood flow is blocked, thereby causing the skill cells to be fall short of oxygen and blood supply. Sleeping quality will be seriously affected under these sleeping conditions, and thus decreasing the immunity of the body as well and lowering the general quality of life.

BRIEF SUMMARY OF THE INVENTION

The present invention provides a health care air-flow heating/cooling mattress. The present invention reduces the pressurized surface area of the body during sleep, as well as causes changes in pressurized body parts during sleep so that different body parts are pressurized in different times in order to ensure smooth blood flow in the capillary vessels.

The present invention has the following technical scheme:

A health care air-flow heating/cooling mattress, comprising a mattress body and a heating/cooling pressurizing device connected with the mattress body; the mattress body comprises circular air sacs that bear pressure independently, square air sacs that bear pressure alternately, heating/cooling air supply pipes evenly distributed on the mattress body, and a pressurizing pipe connected to the square air sacs; the heating/cooling air supply pipes are connected with the heating/cooling pressurizing device; the pressurizing pipe runs inside the heating/cooling air supply pipes; the pressurizing pipe is connected with an air compressor; an air inlet of the pressurizing pipe is provided with a solenoid valve; the solenoid valve is controlled by chips; two sides of said heating/cooling air supply pipes are provided with small blow holes; the small blow holes of two adjacent heating/cooling air supply pipes are provided in staggered arrangement to prevent streams of air flow clash with one another; the circular air sacs are formed by a surface layer and a bottom layer; the surface layer and the bottom layer are pressed together to form a plurality of separate sealed air sacs; a position on the mattress corresponding to a head of a user is arranged with the circular air sacs; the square air sacs are inflatable air sacs which are inflatable or deflatable so as to cause the sealed air sacs positioned above the inflatable air sacs to move up and down.

A zone consisting of the square air sacs has an upper layer, a middle layer and a lower layer, wherein the upper layer being the sealed air sacs, the middle layer being the bottom layer of the circular air sacs, and the lower layer being the inflatable air sacs.

Each row of the inflatable air sacs of the lower layer is further divided into two secondary rows, and in each secondary row, the inflatable air sacs are in communication with one other through air communication holes; the inflatable air sacs are in communication with the pressurizing pipe to increase, maintain or reduce pressure of the inflatable air sacs to achieve deflation or inflation of the inflatable air sacs.

The air compressor and the solenoid valve are mounted inside a machine housing.

The heating/cooling pressurizing device comprises the machine housing, a negative ion generator at an air exit of the machine housing; a fan provided inside the machine housing, and a TCH ceramic far infrared heating element provided inside the machine housing; an exit of the fan is in communication with an air inlet of the TCH ceramic far infrared heating element via a pipe; the fan is formed by a sound proof shell, a high speed smart motor disposed on an upper part of the sound proof shell, and blades provided at an output shaft of the high speed smart motor; the sound proof shell is formed by an upper part and a lower part; the lower part of the sound proof shell forms a spiral shape; the sound proof shell is provided inside a sealed container; shock reduction springs are provided between the sound proof shell and the sealed container; the sealed container is mounted inside the machine housing; a bottom part of the machine housing is provided with an air inlet opening; the air inlet opening is provided with a filter net covering.

The mattress of the present invention uses separate circular air sacs that bear pressure independently, inflatable air sacs, and integrally formed air supply pipes and an independent pressurizing pipe; a time interval from 1 min to 25 mins can be set for the mattress to change its contact with one body part to another body part, so that skin cells of different body parts are subject to pressure against the mattress in different times and thereby being allowed to relax from pressure when not being pressurized against the mattress. Therefore, the present invention ensures healthy cell growth while improving the quality of sleep and enhancing the immune system. The present invention promotes wellness of the body and good quality of life. Moreover, the present invention is silent during operation.

DETAILED DESCRIPTION OF THE INVENTION

Figure 1:
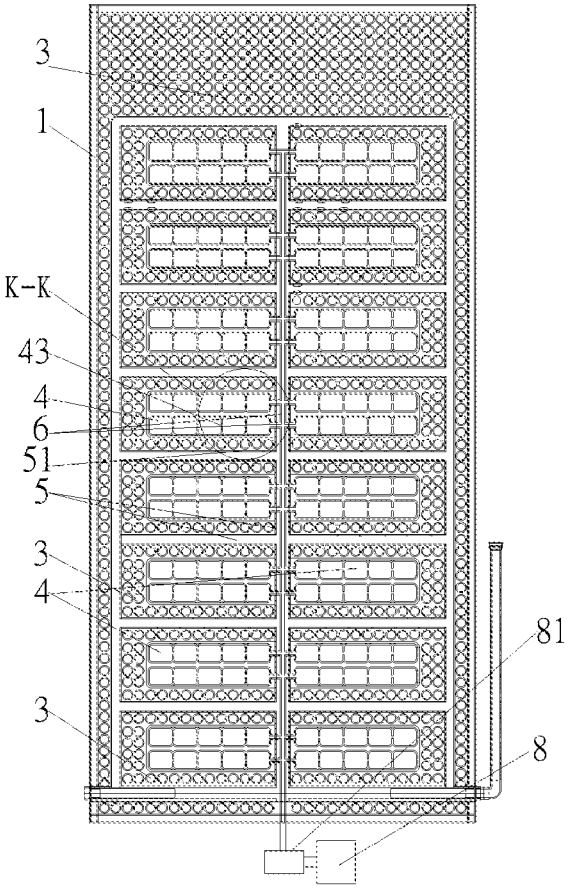
FIG. 1 is a structural view of the mattress body of the health care air-flow heating/cooling mattress according to the present invention.

According to FIGS. 1-5, a health care air-flow heating/cooling mattress comprises a mattress body 1 and a heating/cooling pressurizing device connected with the mattress body 1; the mattress body 1 comprises circular air sacs 3 that bear pressure independently, square air sacs 4 that bear pressure alternately, heating/cooling air supply pipes 5 evenly distributed on the mattress body 1, and a pressurizing pipe 6 connected to the square air sacs 4; two sides of said heating/cooling air supply pipes 5 are provided with small blow holes 51; the small blow holes 51 of two adjacent heating/cooling air supply pipes 5 are provided in staggered arrangement to prevent streams of air flow clash with one another; the circular air sacs 3 are formed by a surface layer 31 and a bottom layer 32; the surface layer 31 and the bottom layer 32 are pressed together to form a plurality of separate sealed air sacs 33; a position on the mattress corresponding to a head of user is arranged with the circular air sacs 3; the square air sacs 4 are inflatable air sacs 42 which are inflatable or deflatable so as to cause the sealed air sacs 33 positioned above the inflatable air sacs 42 to move up and down. As such, a zone consisting of the square air sacs 4 has an upper layer, a middle layer and a lower layer, wherein the upper layer being the sealed air sacs 33, the middle layer being the bottom layer 32, and the lower layer being the inflatable air sacs 42.

Figure 2:
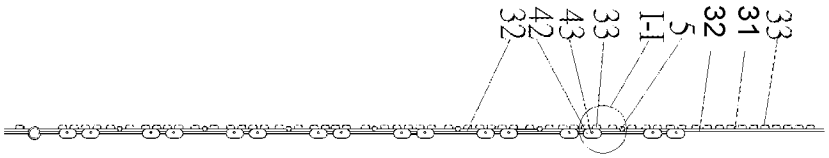
FIG. 2 is a side view of the mattress body according to another embodiment of the present invention.
Figure 3:
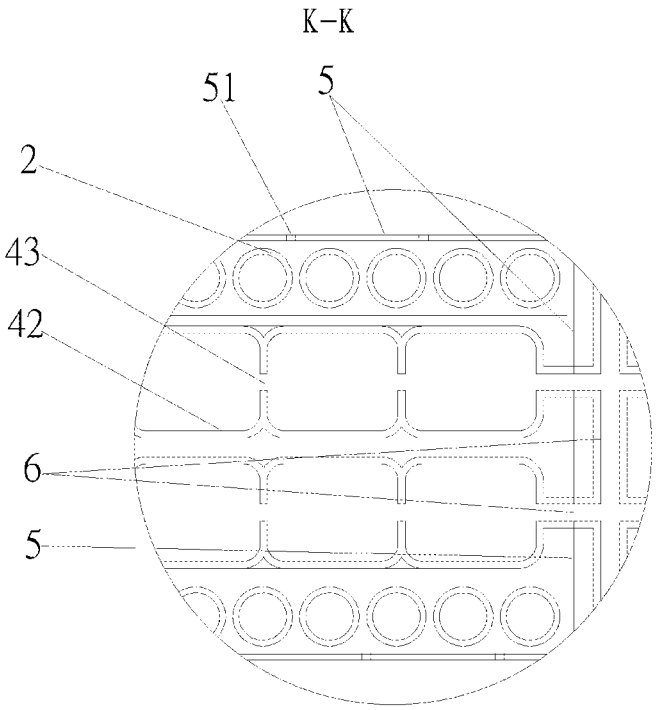
FIG. 3 is the enlarged portion K-K shown in FIG. 1.
Figure 4:
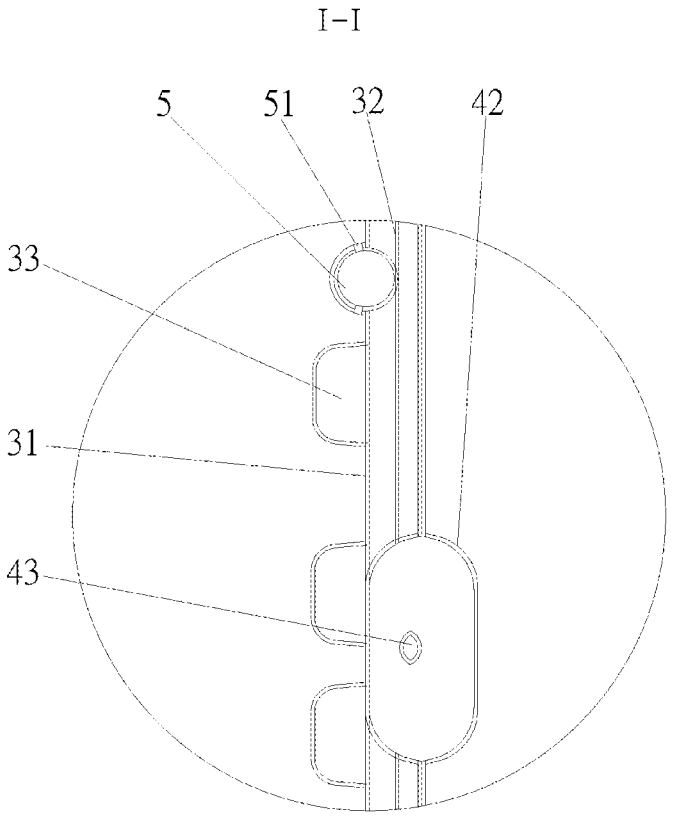
FIG. 4 is the enlarged portion I-I shown in FIG. 2.

According to FIGS. 2 and 4, each row of the inflatable air sacs 42 of the lower layer is further divided into two secondary rows, and in each secondary row, the inflatable air sacs 42 are in communication with one other through air communication holes 43; the inflatable air sacs 42 are also in communication with the pressurizing pipe 6 to increase, maintain or reduce pressure of the inflatable air sacs to achieve deflation or inflation of the inflatable air sacs.

As shown in FIG. 1, the heating/cooling air supply pipes 5 is connected with the heating/cooling pressurizing device; the pressurizing pipe 6 runs inside the heating/cooling air supply pipes 5; the pressurizing pipe 6 is connected with an air compressor 8; an air inlet of the pressurizing pipe 6 is provided with a solenoid valve 81; the solenoid valve 81 is controlled by chips; the air compressor 8 and the solenoid valve 81 is mounted inside a machine housing 21.

Figure 5:
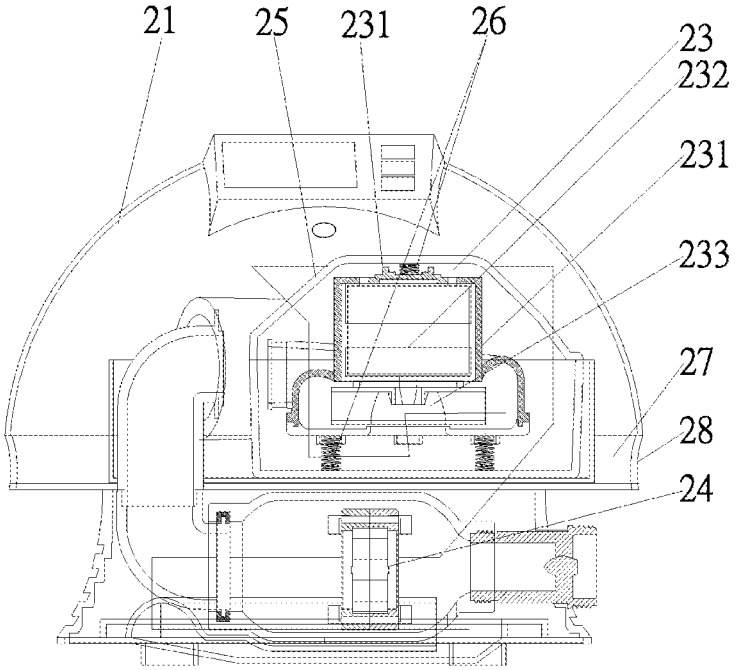
FIG. 5 is a structural view of a heating/cooling pressurizing device according to the present invention.

As shown in FIG. 5, the heating/cooling pressurizing device comprises the machine housing 21, a negative ion generator at the air exit of the machine housing 21; a fan 23 provided inside the machine housing 21, and a TCH ceramic far infrared heating element 24 provided inside the machine housing 21; an exit of the fan 23 is in communication with an air inlet of the TCH ceramic far infrared heating element 24 via a pipe; the fan 23 is formed by a sound proof shell 231, a high speed smart motor 232 disposed on an upper part of the sound proof shell 231, and blades 233 provided at an output shaft of the high speed smart motor 232; the sound proof shell 231 is formed by an upper part and a lower part; the lower part of the sound proof shell 231 forms a spiral shape; the sound proof shell 231 is provided inside a sealed container 25; shock reduction springs 26 are provided between the sound proof shell 231 and the sealed container 25; the sealed container 25 is mounted inside the machine housing 21. A bottom part of the machine housing 21 is provided with an air inlet opening 28; the air inlet opening 28 is provided with a filter net covering 27.

What is claimed is:

1. A health care air-flow heating/cooling mattress, comprising a mattress body and a heating/cooling pressurizing device connected with the mattress body; the mattress body comprises circular air sacs that bear pressure independently, square air sacs that bear pressure alternately, heating/cooling air supply pipes evenly distributed on the mattress body, and a pressurizing pipe connected to the square air sacs; the heating/cooling air supply pipes are connected with the heating/cooling pressurizing device; the pressurizing pipe runs inside the heating/cooling air supply pipes; the pressurizing pipe is connected with an air compressor; an air inlet of the pressurizing pipe is provided with a solenoid valve; the solenoid valve is controlled by chips; two sides of said heating/cooling air supply pipes are provided with small blow holes; the small blow holes of two adjacent heating/cooling air supply pipes are provided in staggered arrangement to prevent streams of air flow clash with one another; the circular air sacs are formed by a surface layer and a bottom layer; the surface layer and the bottom layer are pressed together to form a plurality of separate sealed air sacs which are the circular air sacs; a position on the mattress corresponding to a head of a user is arranged with the circular air sacs; the square air sacs are inflatable air sacs;

the heating/cooling pressurizing device comprises a machine housing, a negative ion generator at an air exit of the machine housing; a fan provided inside the machine housing, and a TCH ceramic far infrared heating element provided inside the machine housing; an exit of the fan is in communication with an air inlet of the TCH ceramic far infrared heating element via a pipe; the fan is formed by a sound proof shell, a high speed smart motor disposed on an upper part of the sound proof shell, and blades provided at an output shaft of the high speed smart motor; the sound proof shell is formed by an upper part and a lower part; the lower part of the sound proof shell forms a spiral shape; the sound proof shell is provided inside a sealed container; shock reduction springs are provided between the sound proof shell and the sealed container; the sealed container is mounted inside the machine housing; a bottom part of the machine housing is provided with an air inlet opening; the air inlet opening is provided with a filter net covering.

2. The mattress according to claim 1, wherein a zone consisting of the square air sacs has an upper layer, a middle layer and a lower layer, wherein the upper layer being the circular air sacs, the middle layer being the bottom layer of the circular air sacs, and the lower layer being the square air sacs.

3. The mattress according to claim 1, wherein the square air sacs are arranged in rows; each row of the square air sacs is further divided into two secondary rows, and in each secondary row, the square air sacs are in communication with one other through air communication holes; the square air sacs are also in communication with the pressurizing pipe.

4. The mattress according to claim 1, wherein the air compressor and the solenoid valve are mounted inside the machine housing.

* * * * *